US005457835A

United States Patent [19]

Manzo

[11] Patent Number: 5,457,835

[45] Date of Patent: Oct. 17, 1995

[54] LEATHER

[75] Inventor: Giovanni Manzo, Naples, Italy

[73] Assignee: Exxon Chemical Patents Inc., Linden, N.J.

[21] Appl. No.: 238,357

[22] Filed: May 5, 1994

Related U.S. Application Data

[63] Continuation of Ser. No. 939,961, Sep. 4, 1992, abandoned, which is a continuation of Ser. No. 294,385, Jan. 6, 1989, abandoned.

[30] Foreign Application Priority Data

Jan. 7, 1988 [GB] United Kingdom ..... 8800299

[51] Int. Cl.[6] ..... C14C 5/00; C14C 11/00

[52] U.S. Cl. ..... 8/94.22; 8/94.23

[58] Field of Search ..... 8/94.22, 94.23

[56] References Cited

U.S. PATENT DOCUMENTS

| | | | |
|---|---|---|---|
| 2,693,996 | 11/1954 | von Fuchs . | |
| 3,749,669 | 7/1973 | Luvisi et al. | 8/94.23 |
| 3,770,370 | 11/1973 | Luvisi et al. | 8/94.23 |
| 3,770,372 | 11/1973 | Luvisi et al. . | |
| 3,784,400 | 1/1974 | Cassella, Jr. | 8/94.23 |
| 4,755,187 | 7/1988 | Friese et al. | 8/94.23 |

FOREIGN PATENT DOCUMENTS

| | | |
|---|---|---|
| 0193832A1 | 2/1986 | European Pat. Off. . |
| 964994 | 7/1964 | United Kingdom . |
| 1297942 | 11/1972 | United Kingdom . |

OTHER PUBLICATIONS

Chemical Abstracts "Impermeability of chrome–tanned leather treated with aldehyde, " . . . etc. vol. 80, No. 10, Mar. 11, 1974, p. 71, Abst. No. 49289s, Columbus, Ohio.

*Primary Examiner*—Jerry D. Johnson
*Attorney, Agent, or Firm*—John J. Mahon

[57] ABSTRACT

Leather products that are well lubricated, impermeable and water-repellent are produced by impregnating tanned leather under alkaline conditions with an aqueous emulsion of an emlsifier carboxylic acids or anhydrides containing at least 16 carbon atoms, in particular polyisobutenyl succinic acid or its anhydride containing at least 30 carbon atoms, or its sulphonic derivative followed by retanning with basic solutions or with the emulsion which is also covered may additionally contain fatty acids.

18 Claims, No Drawings

LEATHER

This is a continuation Ser. No. 07/939,961 filed on Sep. 4, 1992, now abandoned, which is a continuation of Ser. No. 07/294,385, filed on Jan. 6, 1989, now abandoned.

The invention relates to well lubricated leather which may also be impermeable, and water-repellent, in addition the leather can have improved plumpness. The invention also relates to a process for producing such leather which does not significantly change the normal tanning cycle, and new emulsions which may be used in this process.

Products and processes for waterproofing leather have been described for example fluorinated compounds, chromium stearate esters and silicone derivatives have been proposed to impart impermeability to air and water. However, only exceptionally do such substances have the property of inducing good lubrication of the leather fibre and on no account have they been found to simultaneously impart impermeability, water-repellence and lubrication. Lubrication apart, impermeable leather is not water-repellent and vice versa, impermeability being associated with molecular transformation of the water-absorbing loci into water-repellent loci and water-repellence with actual depositing (impregnation) of a water repelling agent between the fibres of the skin, without any reaction.

Impermeable leather, lacking water-repellent properties, will when subjected to water become considerably wet before inhibiting penetration of the water. Hitherto, water-repellent properties have been obtained by a coating and movement of the leather during use will displace the deposit, with consequent loss of the water-repellent properties.

For this reason, water-repellent leathers do not respond well to the I.U.P. 10 dynamic impermeability test. Moreover, it is well known that leathers can lose their impermeability, water repellent properties or lubrication when washed with surfactants or solvents.

In the tanning process leather is generally treated with a strong acid such as sulphuric acid and then with a metal containing tanning agent generally chromium or aluminium. This tends to result in the leather retaining a positive charge particularly in the bulk of the leather even if the surface is subsequently neutralised. Previous proposals have been made in for Example U.S. Pat. Nos. 3,770,372 and 3,784,400 that leather may be lubricated with emulsions of alkyl or alkenyl succinic acids or anhydrides which may also contribute to the waterproof properties of the leather. These processes would result in a hydrophobic product with no water repellence because the alkenyl succinic acid or anhydride remains on the surface of the leather.

The process of U.S. Pat. No. 3,784,400 uses amines such as morpholine as emulsifiers for the alkyl or alkenyl succinic anhydride. In U.S. Pat. No. 3,770,372, the alkyl or alkenyl group contains an average of 12 to 18 carbon atoms whilst in U.S. Pat. No. 3,784,400, the alkenyl group contain from 12 to 24 carbon atoms. In U.S. Pat. No. 3,770,372 the materials are applied under acidic conditions without any retanning after treatment which results in an ionic reaction between the ASA and the positive metal ions present in the tanned leather causing precipitation off the alkyl or alkenyl succinic anhydride (ASA) due to reaction with the metal ion as is shown in Example 3. It is not therefore possible for the ASA to penetrate throughout the leather skin and the lubricating effect is thus reduced.

Another problem in the treatment of leather is a loss of leather plumpness during processing. Plumpness is the bulkiness of the skin and loss of plumpness leads to a thinner harder inflexible and unattractive skin with an undesirable feel.

We have now found that if tanned leather is treated with an emulsion of an organic carboxylic acid or anhydride or derivative thereof under alkaline conditions so that reaction of the carboxylic acid or anhydride and the metal ions in the tanned leather is impeded there is greater impregnation of the leather by the acid. Subsequent acidification ensures an effective bond between the acid and the leather resulting in a significant improvement in the lubrication and plumpness of the leather. We have found this to be particularly the case when the organic carboxylic acid or anhydride, is a polyalkenyl preferably, a polyisobutenyl succinic anhydride containing at least 30 preferably at least 40 carbon atoms in the polyalkene chain.

We have also found that retanning of the lubricated leather results in excellent waterproof and water repellent properties and a product of improved plumpness.

We have also found that by using the techniques of the present invention the bonds between the acid or anhydride and the leather and the retanning agent are sufficiently strong that the improved properties of the leather are retained over prolonged periods of washing with solvents and surfactants. In addition, particularly when using the preferred polyalkenyl succinic acids or anhydrides, we find that the plumpness of the treated leather is significantly improved.

Thus, according to one aspect of the present invention tanned leather is treated with an aqueous emulsion of an alkyl or alkenyl carboxylic acid or anhydride or derivative thereof whose alkyl or alkenyl group contains at least 16 carbon atoms under alkaline conditions such that the tanning agent in the tanned leather is not positively charged and after treatment the system is acidified to enable bonding of the acid or anhydride to the leather or the tanning agents contained the rein.

This process of the invention is not simply an impregnation but impregnation followed by a chemical reaction between the dermic material and/or the tanning agent and the carboxylic acid or anhydride.

In a preferred aspect of the process of the invention the leather obtained by the process described above is retanned to improve its water-repellent properties.

In another aspect the invention provides tanned leather impregnated with a polyalkenyl succinic acid or anhydride or deriviative thereof particularly a polyisobutenyl succinic anhyrdride in which the polyalkenyl group contains at least 25 preferably at least 30 carbon atoms. Also provided is such impregnated leather which has been retanned.

In another aspect, the invention provides the use of an emulsion of a polyalkenyl succinic acid or anhydride or derivative thereof in which the polyalkenyl group contains at least 30 carbon atoms in the treatment of leather under alkaline conditions.

The carboxylic acids or anhydrides used in the present invention are preferably dicarboxylic acids or anhydrides the preferred materials being alkyl or alkenyl succinic acids or anhydrides whose alkyl or alkenyl group contains at least 16 carbon atoms. We have found that polypropenyl or polybutenyl succinic acids containing at least 30 especially at least 60 carbon atoms in the polypropenyl or polybutenyl group are particularly useful. The carboxylic materials may be acids or anhydrides or the derivatives such as the sulphonated derivative thereof. Where dicarboxylic materials are used it is believed that subsequent acidification after impregnation enables one carboxyl group to bond with the metal tanning agents in the leather leaving free carboxyl groups for subsequent reactions particularly in retanning which has been found to give such a significant improvement in water repellancy.

Monocarboxylic acids may also be used but it is preferred that they be used in combination with an aldehyde such as formaldehyde or acetaldehyde to enable subsequent Mannich reaction between the naturally occurring amino groups in the leather and the methyl groups of the acid so again providing free carboxyl groups for further reactions after impregnation and acidification. Examples of suitable mono-carboxylic acids are stearic, oleic, palmitic acids and tall oil fatty acids or mixtures thereof. Mixtures of mono and di-carboxylic acids may also be used and we have found a mixture of $C_6$ to $C_{19}$ mono and di-carboxylic acids to be particularly useful. As discussed later a preferred formulation uses a mixture of such acids together with an alkyl or alkenyl di-carboxylic acid, anhydride or derivative thereof.

The carboxylic acids, anhydrides or deriviatives thereof are applied to the leather as aqueous emulsions and any suitable non-ionic, cationic or anionic emulsifier may be used. We prefer to use a non-ionic emulsifier and have found that ethoxylated and propoxylated emulsifiers are particularly useful, especially polymers and copolymers of ethylene oxide and propylene oxides, propoxylated emulsifiers being preferred due to their biodegradability. Compounds such as alcohols, glycols and acids such as citric or tartaric acid may be used, glutaraldehyde is another preferred emulsifier, examples of other emulsifiers are the cationic sulphonates, and the anionic amine sulphonates.

Care must be taken in the manufacture of the emulsion, it is preferred to use a system containing as little emulsfier as possible since many emulsifiers are hydrophobic and although the leather is washed after treatment some emulsfier remains in the leather which reduces water repellancy.

We have found that salts of fatty acids may be used as emulsifiers, generally as co-emulsifiers which not only reduce the need for traditional emulsifiers but contribute to the leather properties. In a preferred process, for producing the emulsion a polyalkenyl succinic acid or anhydride is prepared by mixing water, emulsifier (preferably an alkoxy emulsifier) and ammonium at typically 60°–80° C. for from 5–20 minutes and blending this emulsion with a component obtained by mixing water, fatty acids and ammonium typically at 40° C. for from 5–20 minutes.

A preferred emulsion contains for 1000 parts by weight of the alkyl or alkenyl carboxylic acid or anhydride or derivative thereof 300 to 1000 parts by weight of water, 50 to 200 parts by weight of emulsifier and sufficient base, preferably ammonia, to ensure the PH is in the range 8 to 10. Where fatty acids are also present we prefer that for 100 to 300 parts by weight based on the alkyl or alkenyl carboxylic acid anhydride or derivative be used. Preferred emulsions contain from 30 to 50 wt % of the alkyl or alkenyl caboxylic acid.

The treatment by the aqueous emulsion may be carried out using the typical drumming techniques used for leather treatment.

In the leather treatment typically the tanned leather is in a drum in water at about 50°–60° C. at a pH from 6–7. According to this invention, the pH in the drum is raised to about 8 preferably by the addition of aqueous ammonia although other bases such as amines, inorganic hydroxides, carbonates and bicarbonates may be used or a mixture may be used. When fatty acids are in use a separate base may be used to neutralise the fatty acids for example sodium bicarbonate may be used, the treating emulsion is then added. Generally from 5–10 wt % of the formulation of this invention based on the weight of the shaved skins is used. This process, produces well lubricated leather, furthermore when the polyalkenyl materials containing more than 30 carbon atoms the lubricated leather has notably improved plumpness. However, the well lubricated leather is water absorbing owing to the presence of free carboxylic groups. If a sulphonated carboxylic acid has been used the sulphonic group which is not coupled can also have an influence on the water-absorbing properties of the material. A further tanning treatment generally with chromium or aluminium basic salts block these groups and produces leather which, after appropriate washing and drying, is impermeable as well as well lubricated.

The retanning with chromium or aluminum salts may not, however, impart the ultimate water-repellent characteristics because the treated leather may contain some residual carboxylic acid or carboxylic acid metal salt complex within the body of the leather. These are often bonded to the leather by hydrogen bonding and water repellancy may therefore be further improved by a treatment to destroy the hydrogen bonding which encourages migration to the surface of the leather to impart water repellency. For example treatment with methylene chloride optionally together with water is very effective alternatively the retanned leather may be treated with a surfactant, followed by contact with a basic ammonia solution for approximately 15 minutes.

Thus to summarise treatment of tanned leather under alkaline conditions makes the chromium or any other tanning metal inactive to the acids, anhydrides or their derivatives and therefore, in contrast to what is described by other authors, carboxylic acids from $C_{16}$, in particular polyethyl succinic acids or anhydrides or their derivatives, can penetrate deep into the structure of the skin. When this has been achieved the acid may be fixed by final acidification, which can also fix the dyes and the re-tanning agents.

Treatment of the leather under alkaline conditions according to this invention enables the use of aqueous emulsions of the acids anhydrides or derivatives of emulsifier:acid ratios of 1:50. Choice of suitable surfactants also makes it possible to operate in baths having the same and even a greater dilution than that usually used in the leather dyeing, re-tanning and oiling process.

The invention also enables the production of leathers which are well lubricated, impermeable and water-repellent having improved plumpness and feel at low cost, in contrast with existing agents, such as those used to impart impermeability and water-repellent properties to leather, whose cost is often extremely high. In addition the invention enables the production of lubricated, impermeable and water-repellent leathers which do not lose these properties during washing or dry cleaning.

The following Examples use a polyisobutylene succinic anhydride from Exxon Chemical whose polyisobutylene group contained 96 carbon atoms.

Example 1 describes the sulphonation of this polyisobutenyl succinc anhydride.

EXAMPLE 1

100 g of EXXON mineral oil is added to 1 kg of the polyisobutenyl succinc anhydride and the mixture is heated to 50° C. 250 g of 36% oleum in $SO_3$ is added in four equal installments at intervals of 1 hour, while stirring. When addition is complete agitation is continued for another 4 hours. The reaction product is then separated and approximately ⅓ of the polyisobutenyl succinc anhydride was found to be sulphonated.

Examples 2 and 3 show the production of an emulsion of a mixture of the sulphonated product of Example 1 and monocarboxylic acids.

EXAMPLE 2

1 kg of the product prepared according to Example 1 is added while stirring to a solution containing 150 g of a mixture of fatty acids (oleic, palmitic and stearic acid) dissolved in an alkaline solution containing 15 ml of a solution of ammonia of density 22 Be. The pH is adjusted to approximately 8–10 by adding more ammonia. 100 g of an ethylene oxide polymer with a number average molecular weight of approximately 1250, previously dissolved in 100 ml of water, are added to the mass, still under agitation which is continued for approximately 20 minutes.

EXAMPLE 3

Example 2 was repeated except that the 15 ml solution of ammonia was replaced by a solution of 10 grams of sodium bicarbonate solution in 100 ml of water and sodium bicarbonate was used to adjust the PH.

EXAMPLE 4

The final compounds of Examples 2 and 3 are emulsified in water by adding to a solution of ammonia at a pH value of approximately 9–10. These emulsions were found to be stable up to a ratio of mixing with water of 1:30 beyond which emulsifiability becomes problematic and recipitation occurs at a ratio of emulsifiable compound to water of 1:50. This limit constitutes a very reassuring margin in comparison with the conditions normally used in the leather treatment cycle.

Example 5 shows the production of an emulsifiable composition of the polyisobutenyl succinic anhydride used in Example 1.

EXAMPLE 5

An alkaline solution of 45 g of sodium carbonate and 180 g of a mixture of ethylene oxide and propylene oxide dissolved in 450 ml of water was added to 1 kg of the polyisobutenyl succinic anhydride. The compound which is made alkaline by the addition of ammonia (pH 8–10) was found to be perfectly emulsifiable in water up to a ratio of 1:50.

Example 6 shows the production of an emulsifiable composition from acid mixtures.

EXAMPLE 6

1 kg of a mixture of mono and di-carboxylic fatty acids ranging from $C_6$–$C_{19}$ is added slowly under agitation to an aqueous solution containing 200 ml of ammonium hydroxide and 50 grams of glutaraldehyde to provide an emulsion containing 25 wt % acid.

The products of Examples 5 and 6 were emulsified by the same process as Example 4.

Examples 7 to 9 show the treatment of leather with the emulsions of Example 4 and the emulsions obtained from Examples 5 and 6.

EXAMPLE 7

Chrome leather which had not been neutralized, is treated in a revolving drum with 200 wt % based on weight of leather of an alkaline solution containing 20–25 g/liter of ammonium hydroxide. The drum is allowed to revolve for 20–30 minutes and then 10–12 wt % based on the drum content of the emulsion of the sulphonated compound of Example 4 is added. The drum is allowed to revolve from 40 minutes to 2 hours depending on the thickness of the skins, then the pH is brought to 7–7.5 by the addition of formic acid and the required quantity of dye is added. This is followed by re-tanning with formic acid until a pH value of 3–3.5 is reached.

The bath is discarded and the leather is re-tanned with 8–10% of chromium salt in 100% of water. The drum is allowed to revolve for approximately 40 minutes to 1 hour and 30 minutes depending on the thickness of the skins. Basification is carried out to pH 5 with a dilute solution of sodium bicarbonate, the bath is discarded and the skins are placed on a stand overnight.

On the following day the skins are treated with a mixture of 10% water and 5% methylene chloride for approximately 20 minutes. The bath is discarded and the skins are washed continuously for approximately 20 minutes, most of the water-absorbing substances being present on the surface of the leather. The leather is then re-finished in the usual manner.

EXAMPLE 8

Example 7 is repeated except that the water-methylene chloride mixture is replaced by a surfactant solution which is followed by contact with 100% of a 5 g/l ammonia solution for approximately 20 minutes.

EXAMPLE 9

Example 7 is repeated except that the product of Example 2 is replaced by the emulsion prepared according to Example 5 in an amount corresponding to 6–10% of the raw leather.

EXAMPLE 10

An emulsion is formed by mixing 1 kg of the polyisobutenyl succinic anhydride used in Example 1

100 g Emulsifier—Soprofer PL/64 from Rhone Poulenc consisting of 40% ethylene oxide 60% propylene oxide and having a number average molecular weight of 3000

300 g Water 80 ml Ammonia at from 60°–80° C. for 10 minutes.

This emulsion was mixed with a separate solution formed by mixing.

300 Water 200 g of the mixture of Fatty Acidsused in Example 6

50 ml Ammonia at 40° C. for 10 minutes.

The mixture was then diluted with water at 60° C. to give an emulsion containing 20 Wt % acids which was added to a drum containing chrome tanned leather in water at 50°–60° C. whose pH had been raised from its original 6 to 7 to 8 by the addition of ammonia. The leather was left in the drum for 40–90 minutes. Followed by acidification and retanning by further treatment with chromium salts and then allowed to dry.

The leather obtained from Examples 7 to 10 were found to have an impermeability corresponding to a resistance in the I.N.P. 10 test of up to 10 hours, their other properties were comparable to those of traditional leather although their plumpness was improved as indicated by the feel of the leather, the technique generally used to assess plumpness.

I claim:

1. A process for lubricating and imparting plumpness to unneutralized tanned leather which contains chromium ions or aluminum ions which comprises the steps of:

(i) contacting said unneutralized leather with an aqueous emulsion of polyisobutylene succinic anhydride having at least 40 carbon atoms, or the sulfonated derivative thereof, said emulsion containing an anionic, nonionic or cationic emulsifier and a sufficient base to provide a pH of from about 8 to about 10, said ions being impeded from reacting with said anhydride or said sulfonated derivative, and said anhydride or said sulfonated derivative being impregnated within said leather, and thereafter (ii) acidifying the interior of the leather prepared in step (i) so that said anhydride or said sulfonated derivative bonds with said ions within said leather.

2. The process of claim 1 wherein the polyisobutenyl succinic anhydride contains at least 60 carbon atoms.

3. The process of claim 1 wherein step (ii) is carried out with formic acid.

4. The process of claim 1 wherein said base is ammonia or an inorganic hydroxide.

5. The process of claim 1 wherein said emulsion contains, for 1000 parts by weight of said polyisobutenyl succinic anhydride or sulfonated derivative thereof, 300 to 1000 parts by weight of water and 50 to 200 parts by weight of emulsifier.

6. The process of claim 1 wherein the emulsifier is a nonionic emulsifier selected from the group consisting of polymers and copolymers of ethylene oxide and propylene oxide.

7. The process of claim 1 which further comprises the third step of retanning the leather with chromium or aluminum basic salts.

8. A process for lubricating and imparting plumpness to a unneutralized tanned leather which contains chromium ions or aluminum ions consisting essentially of the steps of:

(i) contacting said unneutralized leather with an aqueous emulsion consisting essentially of (a) polyisobutylene succinic anhydride having 40 carbon atoms, or the sulfonated derivative thereof, (b) an anionic, nonionic or cationic emulsifier, (c) a sufficient base to provide a pH of from about 8 to about 10 so that said ions are impeded from reacting with said anhydride or said sulfonated derivative, and said anhydride or said sulfonated derivative being impregnated within said leather, and thereafter (ii) acidifying the interior of the leather prepared in step (i) so that said anhydride or said sulfonated derivative bonds with said ions within said leather.

9. The process of claim 8 wherein the polyisobutenyl succinic anhydride contains at least 60 carbon atoms.

10. The process of claim 8 wherein step (2) is carried out with formic acid.

11. The process of claim 8 wherein said base is ammonia or an inorganic hydroxide.

12. The process of claim 8 wherein said emulsion contains, for 1000 parts by weight of said polyisobutenyl succinic anhydride or sulfonated derivative thereof, 300 to 1000 parts by weight of water and 50 to 200 parts by weight of emulsifier.

13. The process of claim 8 wherein the emulsifier is a nonionic emulsifier selected from the group consisting of polymers and copolymers of ethylene oxide and propylene oxide.

14. The process of claim 8 wherein the acidified treated leather is retanned after step 2 with chromium or aluminum basic salts.

15. A process for lubricating and imparting plumpness to tanned leather which contains chromium ions or aluminum ions which comprises the steps of:

(i) contacting said leather with an aqueous emulsion of polyisobutylene succinic anhydride having 96 carbon atoms, or the sulfonated derivative thereof, said emulsion containing an anionic, nonionic or cationic emulsifier and a sufficient base to provide a pH of from about 8 to about 10, said ions being impeded from reacting with said anhydride or said sulfonated derivative, and said anhydride or said sulfonated derivative being impregnated within said leather, and (ii) acidifying the leather prepared in step (i) wherein said anhydride or said sulfonated derivative bonds with said ions within said leather.

16. A process for lubricating and imparting plumpness to tanned leather which contains chromium ions or aluminum ions which comprises the steps of:

(i) contacting said leather with an aqueous emulsion of polyisobutylene succinic anhydride, sulfonated by reaction with oleum in $SO_3$, having at least 40 carbon atoms, said emulsion containing an anionic, nonionic or cationic emulsifier and a sufficient base to provide a pH of from about 8 to about 10, said ions being impeded from reacting ,with said anhydride or said sulfonated anhydride being impregnated within said leather, and (ii) acidifying the leather prepared in step (i) wherein said anhydride or said sulfonated derivative bonds with said ions within said leather.

17. A process for lubricating and imparting plumpness to a tanned leather which contains chromium ions or aluminum ions consisting essentially of the steps of:

(i) contacting said leather with an aqueous emulsion consisting essentially of (a) polyisobutylene succinic anhydride having 96 carbon atoms, or the sulfonated derivative thereof, (b) an anionic, nonionic or cationic emulsifier, (c) a sufficient base to provide a pH of from about 8 to about 10 so that said ions are impeded from reacting with said anhydride or said sulfonated derivative, and said anhydride or said sulfonated derivative being impregnated within said leather, and (ii) acidifying the leather prepared in step (i) wherein said anhydride or said sulfonated derivative bonds with said ions within said leather.

18. A process for lubricating and imparting plumpness to a tanned leather which contains chromium ions or aluminum ions consisting essentially of the steps of:

(i) contacting said leather with an aqueous emulsion consisting essentially of (a) sulfonated polyisobutylene succinic anhydride, treated with oleum in $SO_3$, having at least 40 carbon atoms (b) an anionic, nonionic or cationic emulsifier, (c) a sufficient base to provide a pH of from about 8 to about 10 so that said ions are impeded from reacting with said anhydride or said sulfonated derivative, and sulfonated polyisobutylene succinic anhydride being impregnated within said leather, and (ii) acidifying the leather prepared in step (i) wherein said anhydride or said sulfonated derivative bonds with said ions within said leather.

* * * * *